US005419551A

United States Patent [19]

Hoyt et al.

[11] Patent Number: 5,419,551

[45] Date of Patent: May 30, 1995

[54] MULTI-PURPOSE GOLF TOOL

[76] Inventors: David Hoyt, 1136 W. 135th St., Gardena, Calif. 90247; Gary T. Aldcroft, 3717 California Ave., Long Beach, Calif. 90807

[21] Appl. No.: 262,603

[22] Filed: Jun. 20, 1994

[51] Int. Cl.[6] ..... A63B 57/00

[52] U.S. Cl. ..... 273/32 B; 15/4

[58] Field of Search ..... 273/32 R, 32 A, 32 B, 273/32 H; 15/4

[56] References Cited

U.S. PATENT DOCUMENTS 4,998,726 3/1991 Budnick ..... 273/32 B X

FOREIGN PATENT DOCUMENTS 9101777 2/1991 WIPO ..... 273/32 B

*Primary Examiner*—George J. Marlo

*Attorney, Agent, or Firm*—John J. Connors; Connors & Associates

[57] ABSTRACT

A multi-purpose golf tool 10 comprises a housing 12 having an exterior surface including a first side with a window therein and a second side with first and second openings therein. A score wheel 18 inside the housing 12 has one side with numbers displayed thereon and a rim. The rim partially extends through the first opening to enable the wheel 18 to be manually rotated by pushing against the portion of the rim extending through the first opening. The wheel 18 is mounted so that individual ones of the numbers move in sequence into alignment with the window as the wheel 18 is rotated. A brush 20 mounted within the housing 12 is manually moved between a first position where the brush 20 is enclosed within the housing 12 and a second position where the bristles of the bush extend through the second opening outward from the housing. The tool 10 also includes a fork 22 mounted on the exterior surface of the housing 12 for repairing divots, a belt clip attached to the exterior surface of the housing, and there is a hole in the exterior surface for receiving a ball marker.

10 Claims, 2 Drawing Sheets

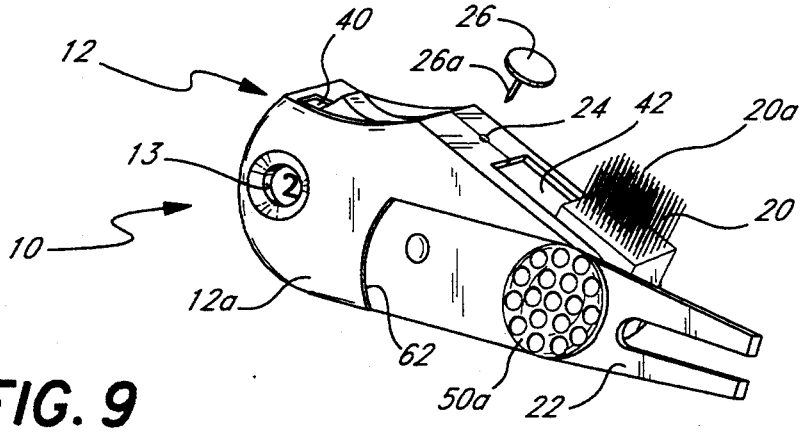
FIG. 7
FIG. 9
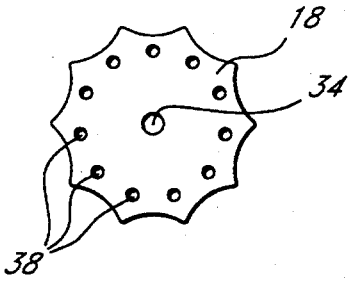
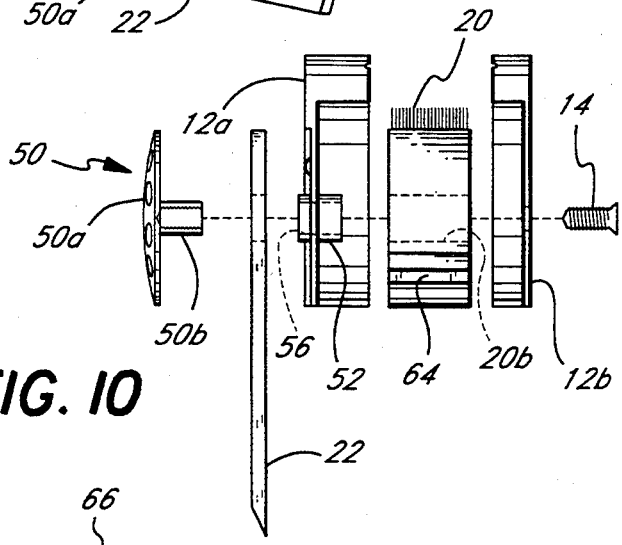
FIG. 10
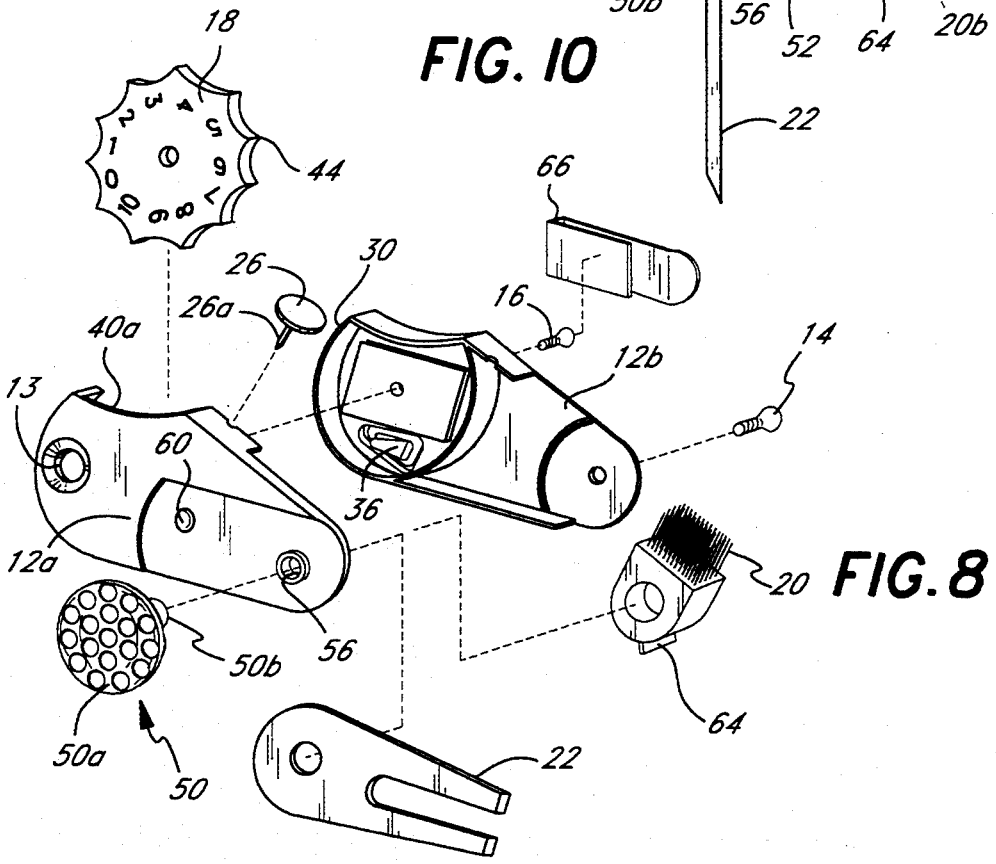
FIG. 8

MULTI-PURPOSE GOLF TOOL

BACKGROUND OF THE INVENTION

1. Field of the Invention

This invention relates to a multi-purpose golf tool, especially one which is compact so that it fits easily in the palm of a user's hand. The tool, for example, has a brush for cleaning golf clubs, a miniaturized fork for fixing divots and cleaning grooves on the face of a golf club, a counter to keep track the score for each hole, a ball marker.

2. Background Discussion

When playing golf it is necessary to keep track of one's score, and it is desirable to repair divots, especially divots made in greens. It is also desirable to have a brush that allows the golfer to clean the face of the golf club when it is covered with dirt and mud. Frequently, golfers carry with them ball markers which look like a thumb tack, including a flat, circular head with a centrally located, outwardly projecting pin that sticks into the green to identify where one's golf ball is located.

SUMMARY OF THE INVENTION

It is the objective of this invention to provide a tool which enables one to keep track of his or her golf score, has a fork for repairing divots, a brush for cleaning golf clubs, and a holder to hold ball markers.

The multi-purpose golf tool of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include simplicity of use, low cost construction, convenience, and portability.

The first feature of the multi-purpose golf tool of this invention is that it includes a housing having an exterior surface including a first side with a window therein and a second side with first and second openings therein. Preferably, the housing fits comfortably in the palm of a golfer's hand, is longer than it is wide, and has opposed first and second ends. The first end is enlarged and rounded and the second end is narrower than the first end. Typically, the housing includes first and second matching sections which are attached to each other to form a connecting side around the perimeter of the housing. The first section has the first side with the window therein and the connecting side has the first and second spaced apart openings therein. The first opening is near the first end and the second opening is near the second end. There may be a belt clip attached to the exterior surface of the housing to enable the tool to be removably attached to the golfer's belt.

The second feature is a score wheel having one side with a series of numbers commencing with 1 displayed thereon and a rim. The wheel is mounted within the housing so that individual ones of the numbers move in sequence into alignment with the window as the wheel is rotated. The rim is partially extending through the first opening to enable the wheel to be manually rotated by pushing against the portion of the rim extending through the first opening. The wheel has on a side opposite the numbers a series of indentations. The housing includes a finger member that engages the indentations to hold the wheel in a position when a number is displayed in the window. The finger member prevents the wheel from being rotated in one direction but allows the wheel to be rotated in the opposite direction.

The third feature is a brush mounted within the housing and a fork element mounted on the exterior surface of the housing. The brush can be manually moved between a first position where the brush is enclosed within the housing and a second position where the bristles of the brush extend through the second opening outward from the housing. The wheel is mounted to one end of the housing and the brush and fork element are mounted at the other end. The fork element is rotatably mounted to be moved between a first position where it is adjacent the first side and is essentially flush with the exterior surface and a second position where it extends outward from the housing. There is a recess in the one side which receives the fork element. The recess includes a detent which holds the fork element in the first position until moved to the second position.

DESCRIPTION OF THE DRAWING

The preferred embodiment of this invention, illustrating all its features, will now be discussed in detail. This embodiment depicts the novel and non-obvious multi-purpose golf tool of this invention shown in the accompanying drawing, which is for illustrative purposes only. This drawing includes the following Figures (FIGS.), with like numerals indicating like parts:

FIG. 7 is perspective view of the tool of this invention, with the fork positioned to extend outward from this tool.

FIG. 8 is an exploded perspective of the tool of this invention.

FIG. 9 is a side view if the score wheel showing indentations opposite corresponding numbers on the opposite side of the wheel.

FIG. 10 is an exploded, fragmentary, cross-sectional view showing how the fork and brush are connected to the housing.

DESCRIPTION OF THE PREFERRED EMBODIMENT

Figure 1:
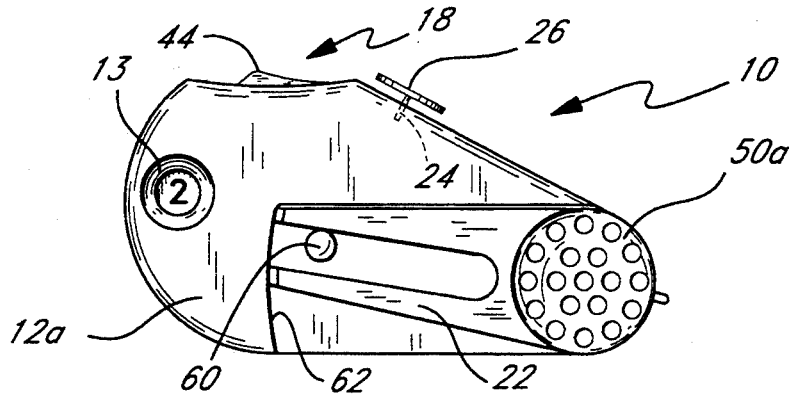
FIG. 1 is a side elevational view of the multi-purpose golf tool of this invention.

As shown in FIGS. 1 through 4, the golf tool 10 of this invention includes a housing 12 formed by two sections 12*a* and 12*b*, each section having essentially the same circumferential configuration, with a window 13 in the forward portion of the section 12*a*. The two sections 12*a* and 12*b* are connected together by screws 14 and 16. Disposed within the housing 12 is a score wheel 18 and brush 20, and mounted on the exterior surface of the one section 12*a* is a fork 22 for repairing divots. Preferably, there is a hole 24 in the connecting sides of the two sections 12 a and 12*b* that has a diameter slightly less than the diameter of the pin 26*a* of a ball marker 26 so that the pin 26*a* can be force fitted into the hole and held in position until removed by the golfer.

Figure 2:
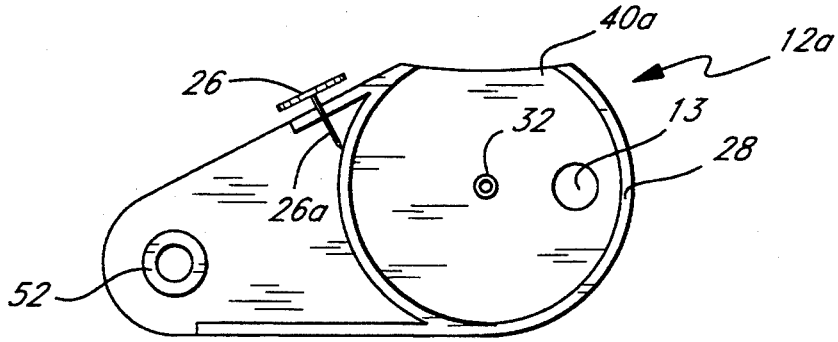
FIG. 2 is a side elevational view of showing the inside of one section of the housing of the tool of this invention.
Figure 3:
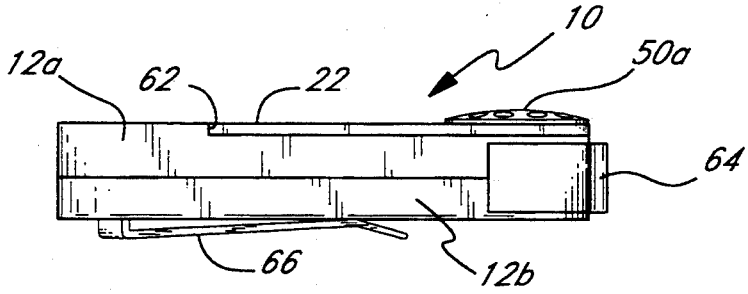
FIG. 3 is a top plan view of the tool of this invention.
Figure 4:
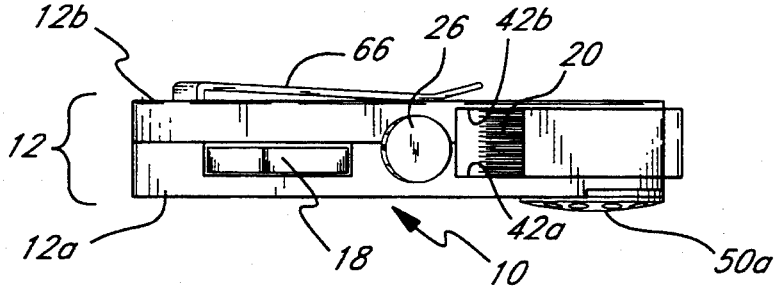
FIG. 4 is a bottom plan view of the tool of this invention.
Figure 5:
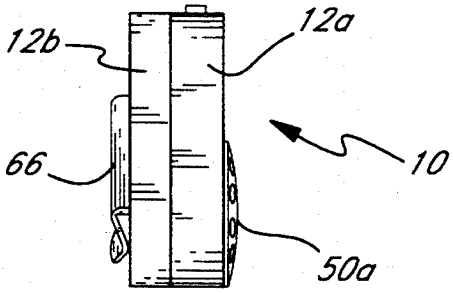
FIG. 5 is a right-hand end view of the tool of this invention
Figure 6:
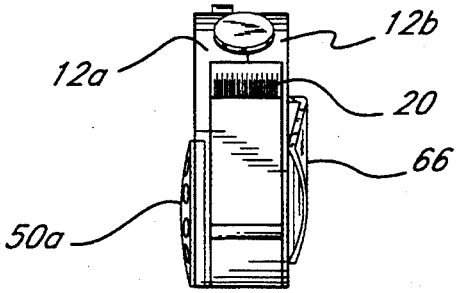
FIG. 6 is a left-hand end view of the tool of this invention.

As best shown in FIGS. 2 and 8, the sections 12*a* and 12*b* each include a substantially circular wall 28 and 30, respectively, into which the wheel 18 is seated. There is an axle 32 extending outward from the central section of the section 12*a* which passes through a central opening 34 in the wheel 18. Seated within the perimeter of the wall 30 is a leaf-spring finger member 36 that engages one of a series of indentations 38 (FIG. 10) in the one side of the wheel 18 as the wheel is manually rotated. The finger member 36 will allow the wheel 18 to rotate in one direction but not the other, with the tip of the finger member 36 engaging an indentation and preventing it from rotating in the counter-clockwise direction as viewed in FIG. 8. On the side opposite the indentations 38 there is displayed a series of numbers in sequence from zero through ten. When the two sections 12*a* and 12*b* of the housing 12 are connected together by the screws 14 and 16 there are cut-away portions 40*a* and 42*a* and 42*b* that form an opening 40 in the forward end of the housing 12 and an opening 42 in the rear end of the housing 12. The rim 44 of the wheel 18 extends through the opening 40 in the forward end allowing the golfer to manually push the wheel 18 in one direction to move in sequence the numbers into position opposite the window 13.

The fork 22 and brush 20 are attached to the same end of the housing 12 and are carried by an axle member 50 that extends through an orifice 56 in a hub 52 carried by section 12*a*. The head 50*a* of the axle member 50 bears against the side of the fork 22 and an axle 50*b* of the axle member 50 extends through the orifice 56 and through a passageway 58 (shown in dotted lines FIG. 9) in the body of the brush 20. The screw 14 is screwed into the axle member 50 so that the brush 20 and the fork 22 may be rotated about the axle 50*b*. The fork 22 is movable from the position shown in FIG. 1 to a position where it extends outward from the housing 12 as illustrated in FIG. 7. A detent 60 in a recess 62 in the side of the one section 12*a* prevents the fork 22 from moving unless it is manually forced by the golfer. There is a tab 64 extending outward from the body of the brush 20 member that enables the golfer to push it against this tab 64 and rotate the brush 20 outward so that the bristles 20*a* of the brush 20 are exposed. By pressing against the tab 64 and rotating the brush 20 in the opposite direction the bristles and body of the brush 20 are moved to within the housing 12 as depicted in FIG. 1. A belt clip 66 is attached to the one side of the housing 12 that enables the tool 10 to be clipped to a golfers belt.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

We claim:

1. A multi-purpose golf tool, including a housing having an exterior surface including a first side with a window therein and a second side with first and second openings therein, a score wheel having one side with numbers displayed thereon and a rim, said wheel being mounted within the housing so that individual ones of the numbers move into alignment with the window as the wheel is rotated and the rim is partially extending through said first opening to enable the wheel to be manually rotated by pushing against the portion of the rim extending through the first opening, a brush mounted within the housing so that it can be manually moved between a first position where the brush is enclosed within the housing and a second position where the brush extends through the second opening outward from the housing and a fork element mounted on the exterior surface of the housing.

2. The multi-purpose golf tool of claim 1 where the fork element is rotatably mounted to be moved between a first position where the fork element is adjacent said first side and is essentially flush with the exterior surface and a second position where the fork element extends outward from the housing.

3. The multi-purpose golf tool of claim 1 where the housing has opposed ends and the wheel is mounted to one end and the brush and fork element are mounted at the other end.

4. A multi-purpose golf tool, including a housing having opposed ends, and an exterior surface including a first side with a window therein and a second side with first and second openings therein, a score wheel having one side with a series of numbers commencing with 1 displayed thereon and a rim, said wheel being mounted within the housing so that individual ones of the numbers in sequence move into alignment with the window as the wheel is rotated and the rim is partially extending through said first opening to enable the wheel to be manually rotated by pushing against the portion of the rim extending through the first opening, said wheel having on a side opposite the numbers a series of indentations, and the housing includes a finger member that engages the indentations to hold the wheel in a position when a number is displayed in the window, said finger member preventing the wheel from being rotated in one direction but allowing the wheel to be rotated in the opposite direction, a brush mounted within the housing so that it can be manually moved between a first position where the brush is enclosed within the housing and a second position where the bush extends through the second opening outward from the housing, and a fork element rotatably mounted on the exterior surface of the housing to be moved between a first position where the fork element is adjacent said first side and is essentially flush with the exterior surface and a second position where the fork element extends outward from the housing, said wheel being mounted to one end of the housing and the brush and fork element being mounted at the other end of the housing.

5. The multi-purpose golf tool of claim 1 where there is a hole in the exterior surface for receiving a ball marker.

6. The multi-purpose golf tool of claim 4 where there is a belt clip attached to the exterior surface.

7. A multi-purpose golf tool, including a housing which fits comfortably in the palm of a hand and is longer than it is wide and has opposed first and second ends, with the first end being enlarged and rounded and the second end being narrower than the first end, said housing including first and second matching sections which are attached to each other to form a connecting side around the perimeter of the housing, said first section having one side with a window therein and said connecting side having first and second spaced apart openings therein, said first opening being near the first end and said second opening being near the second end, a score wheel having one side with a series of numbers displayed thereon and a rim, said wheel being mounted within the housing so that individual ones of the numbers in sequence move into alignment with the window as the wheel is rotated and the rim is partially extending through said first opening to enable the wheel to be manually rotated by pushing against the portion of the rim extending through the first opening, said wheel having a series of indentations on a side opposite the side with the numbers thereon, and said housing including a spring biased finger member that engages the indentations to hold the wheel in a position when a number is displayed in the window, said finger member preventing the wheel from being rotated in one direction but allowing the wheel to be rotated in the opposite direction, a brush mounted within the housing so that it can be manually moved between a first position where the brush is enclosed within the housing and a second position where the bush extends through the second opening outward from the housing, and a fork element rotatably mounted near the second end of the housing to be moved manually between a first position where the fork element is adjacent said first side and is essentially flush with said first side and a second position where the fork element extends outward from the housing, said wheel being mounted to one end of the housing and the brush and fork element being mounted at the other end of the housing.

8. The multi-purpose golf tool of claim 7 where there is a hole in the connecting side for receiving a ball marker.

9. The multi-purpose golf tool of claim 7 where there is a belt clip attached to the exterior surface on a side opposite said one side.

10. The multi-purpose golf tool of claim 7 where there is a recess in said one side which receives said fork element, said recess including a detent which holds the fork element in the first position until moved to the second position.

* * * * *